United States Patent [19]

Overall

[11] 3,994,322

[45] Nov. 30, 1976

[54] HAND FUEL DISPENSER FOR PREVENTING ESCAPE OF VAPORS

[76] Inventor: Milton P. Overall, 4850 Narragansett Ave. - No. 4, San Diego, Calif. 92107

[22] Filed: Jan. 10, 1974

[21] Appl. No.: 432,297

[52] U.S. Cl. ..... 141/46; 55/387; 62/54; 141/285; 220/85 VR

[51] Int. Cl.[2] ..... B65B 31/00

[58] Field of Search ..... 141/52, 53, 44, 45, 141/59, 290, 56, 207, 392, 2, 4–7, 286, 46, 285; 55/74, 387, 88; 220/85 XR, 85 VS, 86 R; 62/50, 51, 54

[56] References Cited

UNITED STATES PATENTS

| | | | |
|---|---|---|---|
| 2,912,830 | 11/1959 | Coldren et al. | 141/2 |
| 3,310,077 | 3/1967 | Mero | 141/286 |
| 3,756,291 | 9/1973 | McGahey et al. | 141/45 |
| 3,776,283 | 12/1973 | Kramer et al. | 141/45 |
| 3,783,913 | 1/1974 | Trusselle | 141/46 |

*Primary Examiner*—Houston S. Bell
*Attorney, Agent, or Firm*—Ralph S. Branscomb

[57] ABSTRACT

The escape of fuel vapors from gasline storge tanks during refueling results in significant air pollution and loss of high octane components of the fuel mixture. Presently available systems all take the approach of drawing these vapors from the auto during refueling, through expensive underground plumbing at each service station and then condensing or absorbing these vapors in one large condensing or absorbing unit. This invention, using replaceable cannisters (containing sufficiently cold contact surfaces for condensing the gasoline vapors at the hand dispenser), uses a pressure drop created by the flowing liquid gasoline to return the vapors condensed in the replaceable cannisters back to the consumers' autos or other vehicles. Thus, considerable savings in construction costs of underground service station plumbing is realized in addition to giving the consumer the (high octane) vapors for which he has already paid. The pressure drop (or "jet pump", as commonly referred to in the industry) also can open various spring loaded valves which can prevent air convection losses when not refueling, thus increasing the time intervals before the (spent) condenser cannisters must be replaced with cannisters (from service station freezers) with frozen heat absorbing brine or other type of ice.

7 Claims, 4 Drawing Figures

HAND FUEL DISPENSER FOR PREVENTING ESCAPE OF VAPORS

This invention present a means for eliminating escape of automobile (and other hydrocarbon fuel consuming vehicles' and power installations') vaporized fuel to the environment during the refueling of said fuel's respective vehicle tanks and storage containers. In addition, liquid fuel losses (spillage) can be eliminated during the "automatic cut-off" of gasoline fuel flow as the automobile's and other vehicle's fuel tanks become full during refueling.

The escape of gasoline fuel, in vapor form within partially full storage tanks, during refueling, results in air pollution of significant levels in metropolitan areas of the world. For instance, under assumed "worst case" conditions for automobiles with virtually empty tanks and at relatively hot ambient temperatures, 30 to 50 grams hydrocarbon per a refueling auto (depending on storage tank size) can be lost to the atmosphere. When one considers that possibly 1 million or more autos in Southern California alone may be partially or totally refueled each day, the magnitude of the effect on the air we breath is apparent. Until the dispensing means for fuel in all service stations and other hydrocarbon fuel dispensing installations are fully automated, some loss of vaporized hydrocarbon fuels during the removal and replacement of the fuel storage tanks' caps will always occur. However, during that much longer (and more environmental damaging) time period when fuel is actually flowing into the fuel storage tank, the incorporation of the device described herein will stop all escape (of the much larger volumes) of vaporized fuel being displaced out of the filling tanks.

The scientific principles upon which this invention is based are threefold: (1) the induction of a low pressure zone in the region of a liquid flowing through a nozzle of a closed system, i.e., a jet pump or aspirator, (2) the condensation of vapors with relatively high boiling points when molecules of said vapors strike a cold surface at a temperature less than their boiling points and (3) the phenomena of brine to remain at a temperature of −4° to +5° F. until all ice in the brine ice mixture has melted.

All presently available systems designed to solve the problem take the approach of taking the vaporized hydrocarbons in the unfilled fuel storage tank (unfortunately, these being the expensive high octane components) from the consumer. This is usually done by each service station having one central, large condensing unit behind the service station with plumbing lines being constructed to each service station pump. Specially designed nozzle assemblies, with lead lines from the hand gasoline dispenser to the underground plumbing connection at each pump, fit up to the openings of each refueling auto's tank opening with flexible canopies and ring (sometimes magnetic) attachments. The entire system is usually under a negative pressure, provided by a central pump, which draws the displaced vapors from each auto tank, during its refueling, back to the central condensation unit (or worse, to a reactor or combustion unit which wastefully burns or eliminates these high octane vapors). These competitive systems are very expensive plus service station plumbing construction costs are prohibitive. Further, the consumer is losing during each refueling the most powerful and expensive gasoline components in the mixture he pays for.

In the invention described herein, condensation of the vapors and their separation from the air is accomplished at the hand dispenser. Thus, no underground plumbing construction costs are incurred (in fact, cost projections under mass produced conditions point to the realization of service station expense for this invention less than the underground plumbing construction costs alone). Further, by using the available head used to pump the liquid gasoline from the underground storage tanks, a pressure drop can be attained in this invention's system to (a) open and close springloaded valves in the hand dispenser unit and (b) return the condensed high octane components back to the consumer's auto in the liquid gasoline flow.

Therefore, an object of this invention is to provide a simple and less costly means for preventing the loss of gasoline vapors during the refueling of auto, other vehiclular, marine and power installation fuel storage tanks.

Another object of this invention is to provide a means to return the vapors usually lost by the consumer refueling his auto back to his storage tank.

A further object of this invention is to provide a gasoline vapor recovery means whereby separation of the vapors from the air being displaced from the auto is accomplished through condensation at the gasoline hand dispenser Other objects and a fuller understanding of the invention may be had by referring to the following description and claims, taken in conjunction with the accompanying drawings in which:

Figures 1, 2, 3, 4:
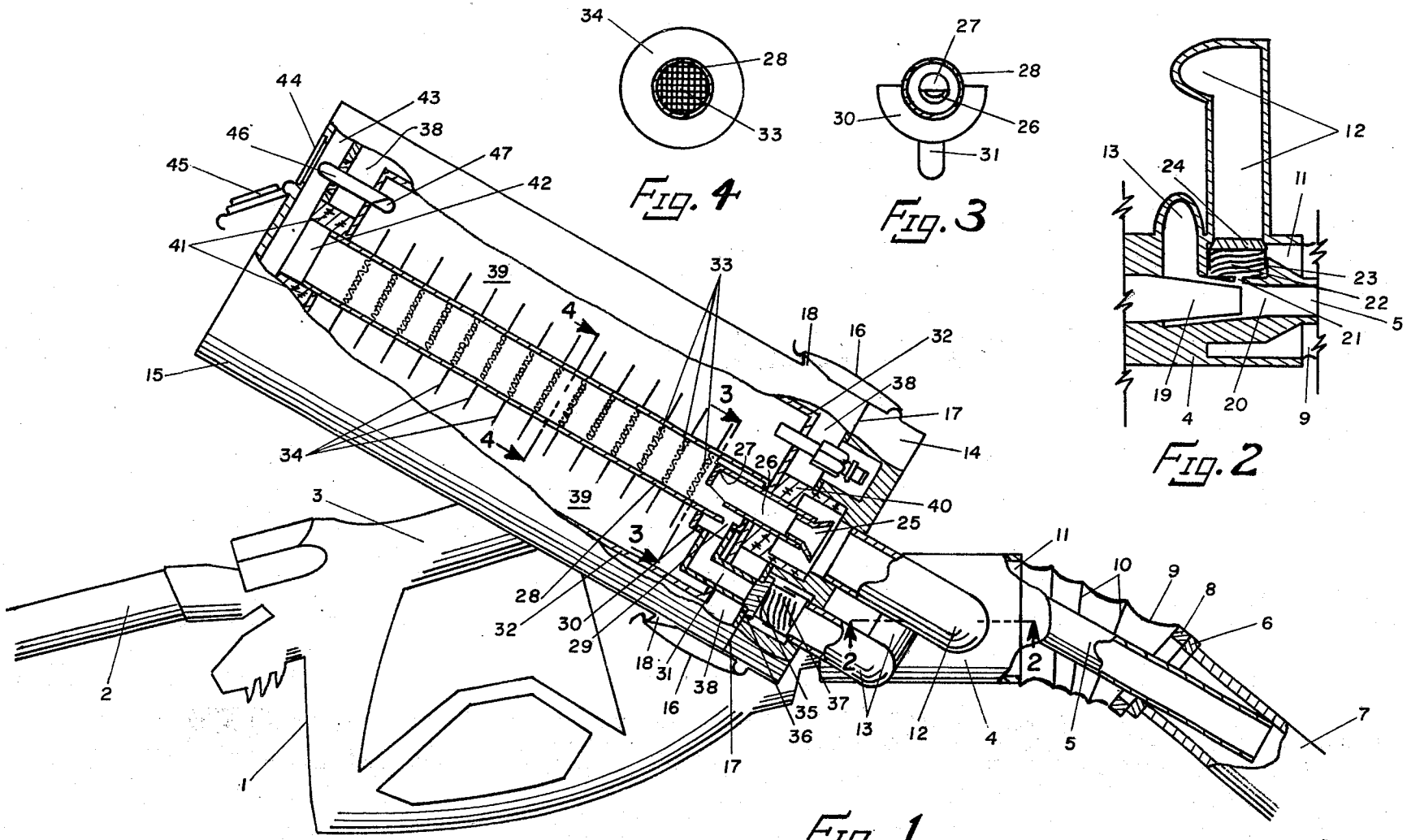
FIG. 1 is a depiction of a hand gasoline dispenser unit with this invention's condensation unit and nozzle/canopy assembly shown substantially in half-section.
FIG. 2 is a more detailed cross-section of the nozzle assembly shown in FIG. 1 but taken along section lines 2—2.
FIG. 3 is a cross-section inside the condenser unit of FIG. 1 taken substantially along section lines 3—3.
FIG. 4 is another more detailed cross-section inside the condenser unit of FIG. 1 taken substantially along section lines 4—4 in FIG. 1.

Referring to FIG. 1, a typical gasoline fuel hand dispenser 1 receives liquid gasoline under pressure from an underground service station storage tank pump through the usual dispenser line 2 with said gasoline flowing through the dispenser handle channel 3 and into the invention nozzel assembly 4. After the liquid gasoline flows through the nozzle assembly 4, it continues through the dispenser snout 5, past the vehicle storage tank opening 6, and into the storage tank entrance tube 7. A closed system (preventing vapor escape to the environment) is achieved between the nozzle assembly 4 and the entrance tube 7 by means of mating by magnetism (as shown) or similar means (including mechanical attachment) with a magnet ring 8. Flexible canopy 9, with adjusting springs 10, closes over nozzle assembly vapor entrance 11 and magnet ring 8 in a air tight attachment manner. Fuel vapors, mixed with air, flow into vapor/air outlet 12 (by means more fully described in reference to FIG. 2 later herein). A fuel condensate/vapor return line 13 also is attached to the nozzle assembly 4 by which the vapors and/or condensates are returned back to the flowing gasoline within snout 5 (explained in FIG. 2 later herein). Vapor/air outlet 12 is rigidly attached to condenser base 14 which in turn is tightly mated to a replaceable condenser cannister 15 which can be removed or held by means of band springs 16 or similar holding means so that a tight air tight fit is made along mating line 17 (circular surface for the cylinderical condenser cannister 15, condenser base 14 exampled here). Band springs 16 may be attachable by hand to a holding means such as knobs 18 on the condenser cannister 15.

Now, referring to FIG. 2, we are able to see how the unique application of the jet pump principle both allows the air/vapors to flow into the condensing system plus achieving the return of the vapors back into the liquid gasoline flow and finally back into the consumers vehicle storage tank. Nozzle assembly 4 contains a inner nozzle 19 through which the pressurized liquid gasoline flows, creating a drop in pressure in jet pump zone 20. This drop in pressure is also realized through inlet spring opening 21 causing inlet spring 22 to collapse within inlet spring cavity 23; the collapse of said inlet spring, occuring only during liquid gasoline flow, pulls back inlet spring stopper 24 allowing the air/fuel vapor flow to progress, with no pressure increase, into vapor/air outlet 12. Vapor or condensates of the recovered fuel vapors are likewise drawn back into the liquid gasoline flow stream through the fuel condensate/vapor return line 13 (with a similar jet pump induced spring retraction action allowing said flow being described more fully in reference to FIG. 1). The use of the flowing liquid gasoline to achieve a jet pump effect to affect opening and closing of springs to allow air/vapor or condensate/vapor flow in the latter case, being drawn to the jet pump induced low pressure zone) is a proprietary feature of this disclosure.

Now again referring to FIG. 1, the continuing path of the air/vapor flow takes into contact with the first condensing cold surface, the water trap 25 which may be an optional feature depending on the degree of water content in the particular gasoline mixture. Ice collects on this water trap 25 with calculations showing that the amount of ice which may be expected to collect under worst case being of such small magnitude that when replaceable condenser cannister 15 is removed for a new, frozen one, to water trap 25 can be removed before ice could build up to unacceptable levels, which would close off flow. Air/vapors, cleaned of any water content in water trap 25 (and also condensing out some of the vapors) proceed into inner cold chamber 26 and against condensate drop diverter cap 27 (with some vapors again being condensed out when contact is made with these cold surfaces). An opening in inner cold chamber 26 lets the air/vapor flow then into the main condensing chamber 28 (exampled here as a copper cylinder). Fueld vapor condensate drops collect in the main condensing chamber 28 and flow (by means of gravity and jet pump induced suction) through main condensing chamber return outlet 29 and into half-circle collecting chamber 30. The jet pump induced pressure drop now takes full effect on drawing the fuel vapor condensates back to the nozzle assembly within the confines of cold return line 31.

The entrance and recovery line structure of condenser cannister 15 is more clearly shown in FIG. 3 (taken substantially along view line 3—3 of FIG. 1). Here we see the condensate drop diverter cap 27 closing off approximately half of the inner cold chamber 26, causing fuel condensate drops to avoid re-entering said inner chamber by means of gravity flow. The main condensing chamber 28 outline is also shown concentric with inner cold chamber 26. The view also showns the half-circle collecting chamber 30 and cold return line 31. Now, while the major type of construction material for the nozzle assembly and outlet/return lines may be of lightweight aluminum or plastic material, for best heat transfer characteristics, copper materials should be considered for the inner condensing surfaces shown in FIG. 1 and 3. Also, because of different alignment of the entire dispenser assembly during refueling various types of autos, more than one main condensing chamber return outlet 29 may be employed within half-circle collecting chamber 30's structure.

Returning now to FIG. 1, the means of containing the heat (condensation) sink source is explained. A radiant heat insulated (foil wrapped or similar reflector) heat sink shell 32 (of stainless steel or suitable material) in-cases the entire condenser heat transfer means, said means being primarily through incorporation of copper screen means 33. Copper screen means 33, placed at appropriate intervals within main condensing chamber 28, condenses out the fuel vapors yet all allows the airflow to pass through without buildup of any pressure in the system. The progressive increase in cold contact surfaces of the multiple copper screen means 33 gleans out the vapors as condensates, said condensates collecting as drops. Under the influence of gravity (and with the optional incorporation of a suitable wetting agent on copper screen means 33), these drops collect at main condensing chamber return outlet 29 and are drawn into cold return line 31 under the influence of the jet pump action (explained more fully below). Instantaneous heat transfer from the copper screen means 33 may be enhanced by the use of copper heat transfer fins 34 brazed on to main condensing chamber 28. Now, while we have used the example of copper screen means 33 as the primary condensing surface of the vapors (and allowance of airflow without pressure buildup), other means may be employed such a baffles or coils and still fall within the proprietary scope of this disclosure.

Cold return line 31, in replceable condenser assembly during operation, sits flush upon inlet spring stop 35, which in turn also closes off vapor return opening 36. Inlet spring stop 35 is rigidly attached to the top of vapor return spring 37 which slides backwards in its cavity under the influence of the drop in pressure due to jet pump action in the refueling operation. Thus, in this example shown, during refueling, air space 38 is evacuated coincidently during the jet pump action, enhancing insulation characteristics of the heat sink shell 32. Now, for permanent "thermos" effect (i.e., continuous heat insulation of heat sink shell 32) heat sink shell 32 can be closed off on cold return line 31 in manufacture, thus having the replaceable condenser (condenser cannister 15) always having a vacuum insulation capability and this type of condenser structure is also claimed as proprietary in this disclosure.

FIG. 4, taken along view line 4—4 in FIG. 1 shows more clearly the example cross-section structure of the main condensing chamber 28, the copper screen means 33 and the copper heat transfer fins 34.

Now, for maximum amount of heat absorbtion capability, the heat sink source 39 (in FIG. 1) is suggested as a brine ice frozen (in the service station freezer) at −20° C. (−4 ° F.). As the vapors are condensed in operation, the brine ice slowly melts yielding salt water and brine ice. The temperature of the brine water (salt water), however, will remain within the temperature range −4 ° to +5 ° F. until all the ice has melted. This temperature range is well below the condensing point (boiling point) of all the gasoline (high octane) components in the vapor of commercial gasoline. Other types of heat sink materials may be employed and still fall within the proprietary scope of this disclosure. Brine ice is exampled herein, however, as some 80,000 calories are required to completely dissolve a 1000 gram quantity of ice, far higher than most inexpensive materials which could be employed as heat sink materials. Calculations show that for a relatively high volume (60,000 gal/month) six pump service station, a 2.2 lb. (1000 gram) brine ice heat sink), attendents may have to replace said condensing cannister only once, at start of shift.

Now, to preserve the heat sink capability as long as possible, cork mating components 40 or similar insulating, construction/mating materials may be used throughout the condenser cannister structure to prevent heat loss. Air outlet cork rings 41 may be used at the end of the condensing cannister to prevent heat from flowing from the environment to main condensing chamber 28. Cleaned air outlet 42, shown here as a plain opening, may also have jet pump actuated valves incorporated (or manually replaceable caps) to prevent heat loss from air convection. Said valves (not shown here but claimed within the scope of this disclosure) may also be used for the same purpose in the structure of vapor/air outlet 12.

Intermediate chamber 43 may be incorporated as a "heat transfer buffer zone" to cut air convection heat losses in coordination with final outlet 44 which is closed off manually when not in operation by close cap 45. Again, jet actuated valves may be substituted for manually air convection heat loss preventive means (heat transfer buffer zone, close cap 45) and are recognized within the scope of this disclosure.

A simple means of determining when the temperature of the heat sink source 39 has risen, to a temperature level to be replaced by the service station attendent is change indicator tube 46 which contains a red dyed fresh water ice 47 which will melt out at a predetermined temperature and show a red liquid to the service station attendent, indicating a replacement frozen condenser cannister is needed.

Means, not shown, such as a cup or cone condensate collectors can be incorporated within means condensing chamber 28's structure (near cleaned air outlet 42) to catch and collect for the next auto refueling those vapor condensates which do not have time to flow to condensing chamber return outlet 29 during a single car's refueling. Further, while we have exhibited the condensing cannister as connected to the nozzle assembly 4 in this disclosure, it should also be understood that the placement of the condensing cannister can be near or within the individual service station pumps assembly, thereby incorporating a lead line (not shown) from the nozzle assembly 4 to the removed condenser cannister. In such case, and being claimed as also proprietary to this disclosure, the service station has the option of still returning the condens-vapors back to the consumer's auto (through an extension of condensate/vapor return line 13) and lessening the weight at fuel hand dispenser 1, or, by placing a suitable collection apparatus at the removed condenser cannister, retain those vapors for the service station's benefit (i.e., no condensate vapor return line 13). Both of the immediately above options are claimed within the scope of disclosure.

Although I have described my invention with a certain degree of particularity, it is understood that the present disclosure is made by way of example only and that numerous changes and arrangements of the parts, and their associated dimensions/materials, of this invention may be resorted to without departing from the spirit and scope of the invention as here and after claimed.

I claim as my invention:

1. A refueling means for filling fuel storage tanks comprising:

a. a hand fuel dispenser having a snout to introduce fuel into a storage tank inlet and a fuel passageway to deliver fuel to said snout from an external source;

b. refrigerated condenser means;

c. means for sealing a storage tank inlet from the atmosphere;

d. means defining a vapor passageway from said sealing means to said condenser means to pass vapors forced from a fuel storage tank by ingoing fuel;

e. conduit means connected to and between said condenser means and said snout for returning condensed fuel vapors directly into a fuel storage tank; and f. an outlet defined in said dispenser and communicating with said condenser to vent air from a storage tank to the atmosphere.

2. Structure according to claim 1 wherein said condenser means comprises a cannister mounted directly on said hand dispenser and having a coolant therein.

3. Structure according to claim 2 wherein said coolant is at least partially frozen brine.

4. Structure according to claim 2 wherein said cannister is manually removeable from said hand dispenser for replacement.

5. Structure according to claim 2 wherein said cannister comprises an inner chamber to receive vapors from said vapor passageway means and an outer chamber surrounding said inner chamber for containing said coolant, said inner chamber having a plurality of metal grids therein to transfer heat and provide increased condensation surfaces for vapors in said inner chamber.

6. Structure according to claim 2 and including a closed container at least partially contacting said coolant and transparent at least in part and further including a colored temperature indicator substance partially filling said container and having a melting point near the maximum permissible temperature of said coolant, whereby upon said coolant exceeding said maximum permissible temperature, a visual indication of such condition is evidenced by the liquidation of said substance.

7. Structure according to claim 4 wherein said fuel conduit has a pressure-operated valve therein normally closing same and operable by the existence of a low pressure in said chamber to open said fuel conduit.

* * * * *